United States Patent [19]

Beumer

[11] 4,434,603

[45] Mar. 6, 1984

[54] PLANT FOR PRODUCING PALLETLESS STACKS OF PIECE GOODS, PARTICULARLY SACKS AROUND WHICH IS SHRUNK A SHEET

[75] Inventor: Bernhard Beumer, Beckum, Fed. Rep. of Germany

[73] Assignee: Bernhard Beumer Maschinenfabrik KG, Beckum/Westfalen, Fed. Rep. of Germany

[21] Appl. No.: 281,555

[22] Filed: Jul. 8, 1981

[30] Foreign Application Priority Data

May 21, 1981 [DE] Fed. Rep. of Germany ..... 3120215

[51] Int. Cl.[3] ..... B65B 55/06; B65B 35/50

[52] U.S. Cl. ..... 53/557

[58] Field of Search ..... 53/442, 463, 452, 461, 53/203, 557, 567

[56] References Cited

U.S. PATENT DOCUMENTS 3,640,048 2/1972 Zelnick et al. .
3,995,410 12/1976 Berghgracht ..... 53/557 X
4,060,957 12/1977 Birkenfeld et al. ..... 53/557 X
4,258,533 3/1981 Aka et al. ..... 53/557 X

FOREIGN PATENT DOCUMENTS 2303128 8/1974 Fed. Rep. of Germany .
2944321 5/1981 Fed. Rep. of Germany .
722474 3/1980 U.S.S.R. .

*Primary Examiner*—Horace M. Culver
*Attorney, Agent, or Firm*—Spencer & Frank

[57] ABSTRACT

The invention relates to a plant for producing pallet-less stacks of bundles and particularly sacks around which is shrunk a sheet with which the bundle is palleted, the bundle stack is provided with a first cover sheet and is covered with a sheet covering, the packing sheet is shrunk, the stack is rotated by 180°, is provided with a second top sheet, which is in turn shrunk and at the end of the plant the sheet-wrapped pallet loads are accumulated in such a way that one or more loads can simultaneously be removed transversely to the stack conveying direction leading to sheet-wrapped bundle stacks with perfectly formed free spaces in the vicinity of the stack base surface for the engagement of conveying and lifting mechanisms.

8 Claims, 11 Drawing Figures

PLANT FOR PRODUCING PALLETLESS STACKS OF PIECE GOODS, PARTICULARLY SACKS AROUND WHICH IS SHRUNK A SHEET

BACKGROUND OF THE INVENTION

The invention relates to a plant for producing palletless stacks of piece goods, particularly sacks around which is shrunk a sheet, with free spaces formed in the vicinity of the stack base for inserting conveying and lifting mechanisms, such as the arms of the fork of a fork lift truck or the like, using a stacking conveyor belt.

Methods and apparatuses for producing protective packings of shrunk plastics film or sheeting for load units of a plurality of superimposed layers of piece goods or bundles and a bottom bundle layer, which acts as an auxiliary pallet, with a smaller base surface than that of the superimposed layers of bundles, whilst forming free spaces located laterally of the auxiliary pallet for the engagement of the fork arms of fork lift trucks during the transportation of the load units are known in various forms.

Thus, from DOS No. 2,303,128, published Aug. 1, 1974 a bundle is known comprising a plurality of layers of superimposed packing articles which is surrounded by a plastics sheet, where the lowermost layer bends at a considerable distance from the lateral edges of the layers placed thereon, so that as a result two elongated spaces are formed for receiving the forked members of a fork lift truck. The plastics sheet extends into these spaces in such a way that it completely surrounds the faces thereof turned outwards and downwards. The lowermost layer of the packing articles is separately wrapped in a plastics sheet, whilst a further plastics sheet for covering the upper layers is welded or heat sealed at least along two parallel longitudinal sides to the plastics sheet covering the lower layer. Such a load unit comprising a plurality of superimposed bundle layers is provided with an auxiliary pallet formed from a bundle layer with a smaller bearing surface than the base surface of the actual stack. This bundle layer acting as an auxiliary pallet is separately wrapped prior to the wrapping of the entire stack with sheeting. The edges of the sheeting are welded, so that a water-tight wrapping for the auxiliary pallet is obtained. The individual bundle layers stacked on an auxiliary pallet formed in this way are then combined as a stack, wrapped by means of a vertical sheet banderole having in the upper area a projecting sheeting length, welded together at the facing edges, whilst the tips which are thereby formed are simultaneously engaged on the top of the stack. The actual load units can be produced in such a way that the auxiliary pallet comprising a bundle layer is placed on the top of the stack formed and the latter is placed on a sheet subsequently forming the upper cover of the protective pack. The stack is then wrapped in sheeting and at the same time the sheeting is guided in the vicinity of the recesses formed by the auxiliary pallet with respect to the underlying bundle layer for engaging the fork arms of fork lift trucks during the transportation of the load units. The sheet wrapping placed over the stack is then edge-welded to the cover sheet and, at the end of the sheet shrinkage process, the complete load unit is turned by 180°, so that the initially uppermost auxiliary pallet forms the base surface for the stack. However, in this known construction it is disadvantageous that the most stressed points of the protective pack are only constructed in single-layer form and that there is no accurate formation of the recesses for inserting the fork arms of fork lift consequently damage can, in particular, occur in this sheeting area in which the fork arms of the fork lift trucks are inserted below the load laterally of the auxiliary pallet.

The use of partly sheet-wrapped pallets for producing load units is also known from U.S. Pat. No. 3,640,048. According to this patent, such a load unit is produced in that a sheet blank with an all-round sheet projection is placed on the unloaded pallet. Successive bundle layers are then placed on the thus prepared pallet to form a stack. Before or after fitting a vertical sheet banderole to the stack, a cover sheet is placed on the uppermost bundle layer and the vertical sheet banderole, the cover sheet and the lower sheet blank are welded and shrunk around the pallet load.

In addition, a method is known, from DAS No. 2,614,558 published Aug. 28, 1980 (corresponding in part to U.S. Pat. No. 4,060,957 issued Dec. 6, 1977) for producing a packing unit, which is completely wrapped in a shrink sheet or film, has no pallets and comprises a plurality of layers of stacked articles. Initially, several layers of articles with the same base area are stacked one upon the other. Then a special layer of articles is stacked in such a way that at least two parallel recesses are formed at right angles to the stack conveying direction for the subsequent engagement of the supporting members of a lifting appliance. A first dome-shaped covering of shrink sheeting is drawn from above over the complete stack and is then shrunk closely onto the latter by heat application. The complete stack is then turned by 180° in such a way that the special layer with the recesses is located at the bottom. However, this leads to the advantage that the sheet-wrapped stack can only be removed at right angles to the longitudinal direction of the conveyor belt, because the recesses are also transversely directed on either side of the special layer. In this known method, prior to stacking the special layer, an additional plastic sheet is placed on the stack, whose edges which are parallel to the recesses hang down somewhat laterally of the stack. After turning the stack by 180°, a second dome-shaped shrink sheeting is drawn over the stack and is closely shrunk thereon by heat application in such a way that the areas of the additional plastics sheet positioned laterally of the stack form three-layer overlapping areas for the lateral areas of the first covering and lateral areas of the second covering.

The high consumption of shrink sheeting for the two dome-shaped sheet coverings drawn over the stack is a disadvantage of this known method. As the coverings are formed from a correspondingly folded sheet web and it is necessary to separate the necessary covering length from said web, the upper and lower areas of the coverings drawn over the stack have, in each case, a weld located inter alia on the upper surface of the sheet wrapping. This is disadvantageous with regard to the sealing action, because such welds can easily be damaged and also are detrimental to the strength of the wrapping sheet. It is also disadvantageous that the sheet-wrapped stack is not supported after leaving the rotating mechanism in the vicinity of its two free spaces adjacent to the layer forming the base surface of the stack. Due to the lack of such a support the stack obtained does not have an adequate strength and in addition the projecting portions of the layer resting on the auxiliary pallet hang down into the free space area, so that often there is not enough space for inserting the fork of a fork lift truck. The further heating of the complete sheet wrapping for shrinking the applied second sheet covering reduces the strength of the complete sheet wrapping, because it has been found that if a wrapping sheet is heated a number of times its strength is reduced.

BRIEF SUMMARY OF THE INVENTION

The object of the present invention is to provide an installation making it possible to produce a pallet-less stack of piece goods or sacks around which is shrunk a sheet or film whilst economising on sheet material and whilst ensuring a minimum heating of the sheeting during the shrinkage process to avoid a reduction of its strength and whilst simultaneously increasing the stability of the stack with a high degree of sealing of the sheet wrapping and whilst avoiding a weld in the upper area of the sheet-wrapped stack. In addition, it is simultaneously possible to remove at least two sheet-wrapped stacks.

According to the invention, this problem is solved by the combination of the following devices arranged in the vicinity of the conveyor belt:

(a) a device for forming individual bundle stacks, with a base surface at the top and with free spaces parallel to the stack feed direction on either side of the bundle layer forming the stack base surface, including a bundle row storage means, a horizontally and vertically adjustable packing table to which are supplied the individual bundle rows by means of a transfer mechanism for forming bundle layers on the packing table, and a bundle layer hold-back ledge in the horizontal movement area of the packing table for transferring the individual bundle layers from the packing table to the conveyor belt or onto the uppermost bundle layer of a partial stack already formed on the conveyor belt, (b) a device for applying a top sheet to the upper bundle layer forming the base surface of the stack, (c) a device for covering the stack by means of a dome-shaped sheet, the device having a welding and cutting device for sealing the top end of the sheet web portion for forming the dome-shaped sheet covering and for cutting the in each case necessary length of a sheet web portion a stack from a hose-like sheet web folded in concertina-like manner in the longitudinal side area from a sheet delivery reel located above the stack movement path, wedge plates for opening the sheet web, a gripping device for gripping the lower edge of the sheet and for covering the stack with the sheet, the gripping device being movable by means of a drive mechanism from an upper gripping position to a lower spreading or expanding position laterally of the stack, and a lateral edge control device for guiding the sheet web from the reel to the vicinity of the stack to be wrapped, (d) a device for shrinking the dome-shaped sheet covering drawn over the stack, the shrinkage device being dome-shaped and having a plurality of superimposed and individually or jointly operable ring nozzles, (e) a device for pressing the portions of the sheet covering located in the vicinity of the free spaces of the stack onto the wall surfaces bounding the latter, said device comprising pressure rollers movable laterally into the area of the free spaces of the stack close to the device, (f) a device for rotating the stack with the shrunk sheet covering by 180° in the direction of the stack feed path and having supporting devices engaging in the free spaces of the stack, (g) device for placing a top sheet having a larger area than that formed by the upper bundle layer of the stack onto the latter and which comprises a sheet delivery reel and a cutting device, (h) a device for shrinking the top sheet by local heating thereof and having pressing devices for pressing the laterally projecting portions of the top sheet onto the shrunk dome-shaped sheet covering and a following air cooler for the heated top sheet, (i) horizontal supporting devices disposed on the conveyor belt portions following the stack rotating device so as to extend into the free spaces of the stack so as to support same, and (j) a conveyor belt end portion which is constructed as an accumulation belt.

By means of a plant constructed in this way it is possible to produce a pallet-less stack of bundles and particularly stacks around which is shrunk sheeting, because each individual stack of bundles is covered by a single dome-shaped sheet covering. The remaining unprotected part of the stack is sealed by means of a shrunk-on top sheet, whose edge portions project laterally over the bundle layer surfaces are in contact with the sheet covering and are simultaneously welded and shrunk thereto. Due to the fact that after applying the top sheet, the subsequent shrinkage process only extends to the vicinity of the top sheet, the already sheet-wrapped part of the stack is exposed to no further heating, so that a high strength sheet wrapping is obtained. There is also the further advantage that through the use of a top sheet in the upper top area of the sheet-wrapped stack no weld is formed, so that a high strength sheet wrapping of the stack is obtained. The free spaces formed laterally in the vicinity of the bundle layer forming the base surface of the stack are perfectly constructed for each sheet-wrapped stack, which can be attributed to the fact that after leaving the rotating mechanism, each stack is supplied to the end of the conveyor belt in such a way that the free spaces formed on the bottom have a continual support so that there is no hanging down of the bundle layers over the auxiliary pallet in the vicinity of the free spaces.

Further advantageous developments of the invention can be gathered from the subclaims.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

According to FIGS. 1 and 2, the plant for producing pallet-less stacks of piece goods or sacks around which is shrunk sheeting comprises a conveyor belt 10, e.g. constructed as a roller belt, on which are moved the individual pallet-less stacks 100 to be packed by means of the sheeting and which in the embodiments described hereinafter are constituted by sacks. In the vicinity of the conveyor belt 10 are provided subsequently defined devices for forming the individual stacks of sacks and for wrapping the latter in sheeting. Advantageously, conveyor belt 10 comprises individual conveyor belt portions 16, 11, 12, 13, 13*a*, 14 and 15, the individual devices being positioned in the vicinity thereof. Each conveyor belt portion is constructed as a function of the associated device for advancing the stack. A joint control device 110 controls the feed or advance movements of the conveyor belts of the individual conveyor belt portions in such a way that the sack stacks to be packed pass through and stop in the vicinity of the individual devices, so that the individual work functions thereof can be performed.

Figure 3:
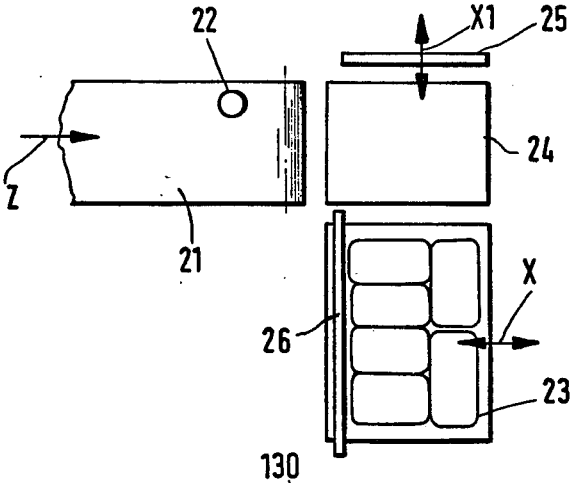
FIG. 3 the device for forming individual sack stacks in a diagrammatic plan view.

The individual sack stacks 100 are produced by means of a stack formation device 20 having a conveyor belt 21 for supplying the individual sacks for sack layer formation. At the discharge end of conveyor belt 21 is provided a vertically adjustable packing table 23 which is mounted in a machine frame 27 and which can also be displaced horizontally (FIGS. 1 and 3). Between the discharge end of conveyor belt 21 and packing table 23 can be provided sack row storage means (not shown in FIG. 1) on which can be lined up the sack supplied by conveyor belt 21 for subsequent transfer to packing table 23 by means of transfer devices. In the embodiment of the sack stack formation device 20 shown in FIG. 3, the individual sacks are supplied to the sack row storage means 24 in the direction of arrow Z. By means of the rotating mechanism 22, the sacks arriving in the longitudinal direction are transferred into a transverse position so as to obtain the sack layer packing arrangement shown in FIG. 3. The individual sack layer formed and prepared on the sack row storage means 24 is transferred by means of a transfer mechanism 25 onto a packing table 23, mechanism 25 comprising a transfer ledge displaceable in the direction of arrow X1. For the transfer of a layer of sacks from the sack row storage means to packing table 23, the latter is moved to a height in machine frame 27 at which is located the storage means 24, which can be constructed e.g. as a roller belt. On sack row storage means 24 can be formed individual sack rows which, after a corresponding transfer to packing table 23, can be formed into individual layers thereon. However, it is also possible to form the individual sack layers on the sack row storage means 24.

If a sack layer is arranged on packing table 23, the latter is lowered into the vicinity of conveyor belt 16 which is positioned below packing table 23 and which forms part of conveyor belt 10. By moving packing table 23 in the direction of arrow X the sack layer is transferred to conveyor belt 16 or onto the uppermost layer of an already partly formed stack, indicated at 100*a* in FIG. 1.

Figure 8:
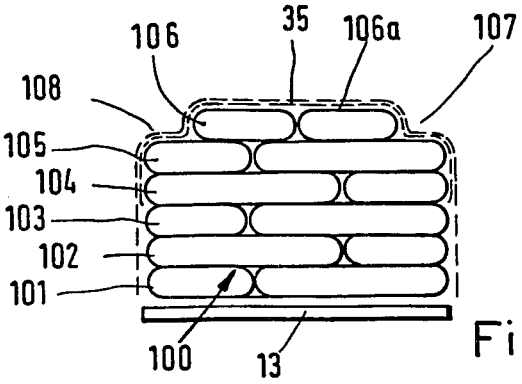
FIG. 8 a front view of a stack of sacks wrapped with a sheet covering.

After a plurality of sack layers 101, 102, 103, 104, 105, as shown in FIG. 8, have been combined into a stack, a further sack layer 106 is placed on the uppermost layer 105 and represents the auxiliary pallet and consequently the base surface of the subsequent sack stack. However, this sack layer 106 has a smaller area than the other sack layers 101 to 105 of the sack stack, so that free spaces 107, 108 are formed on facing sides of sack layer 106.

Figure 7:
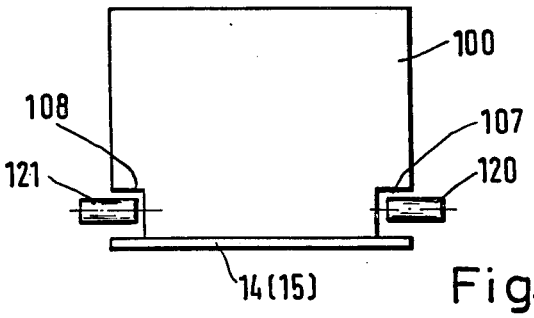
FIG. 7 a view of the stack of sacks in the direction of arrow A in FIG. 6.

The individual sack stacks 100 produced by means of the sack stack formation devices 20 are arranged on conveyor belt 10 or on conveyor belt portion 16 in such a way that the free spaces run parallel to the longitudinal direction of conveyor belt 10, as shown in FIG. 7.

In order to ensure a completely satisfactory transfer of the sack layers from packing table 23 to conveyor belt 10 or onto the uppermost sack layer of a partial stack 100*a*, as can be seen in FIG. 3 above table 23 is provided a hold-back ledge 26, so that when table 23 has moved in the direction of conveyor belt 21, the sack layer is supported on ledge 26 and consequently cannot be displaced by the returning table 23. This prevents any tearing apart of the layer of sacks. When the sack layer has been discharged from packing table 23, the latter is advanced again until it has assumed the position shown in FIG. 3. Packing table 23 is then raised again in the vicinity of the sack row storage means 24 in order to take up a sack row or layer already prepared on the latter. If once again there is a sack layer on packing table 23, the latter is lowered into the particular discharge area.

The aforementioned sack stack formation device 20 can be replaced by other per se known devices.

The sack stack formation device 20 is followed by a device 30 for applying a top sheet 35 to the upper sack layer 106 forming its base surface 106*a*. Device 30 comprises a sheet delivery reel 31, located above conveyor belt 10 or conveyor belt portion 12 and above the movement path of the individual sack stacks in a machine frame 37. It is provided with devices for removing the length necessary for producing top sheet 35 and which are not shown in the drawings. By means of a correspondingly constructed separating or cutting device, the necessary length of top sheet 35 is then removed from the sheet web and sheet 35 is simultaneously placed on the stack. The size of the top sheet 35 is dimensioned in such a way that an edge portion thereof engages over the side wall faces of the sack stack (FIGS. 1 and 8).

As can be gathered from FIGS. 1 and 2, a further conveyor belt portion 11 can be positioned between portions 16 and 12 of conveyor belt 10 and on which already formed sack stacks can be collected for passing through devices which will be described hereinafter.

Figure 11:
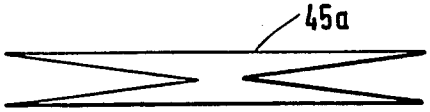
FIG. 11 a cross-section through the sheet web for producing dome-shaped sheet coverings.

Device 30 is followed by a device 40 for covering sack stack 100 with a dome-shaped sheet covering 45. Device 40 comprises a delivery reel 41 for a sheet web 45*a* folded in the lateral longitudinal area in hose-like, concertina-like manner (FIG. 11). Reel 41 is also arranged above the movement path of the sack stack in machine frame 37. By means of guide rollers arranged in the machine frame 37, sheet web 45*a* is guided from delivery reel 41 in the area in which sheet covering 45 is drawn over the sack stack located on conveyor belt portion 12. The free end of sheet web 45*a* then comes to rest over the sack stack to be covered with sheet covering 45. In this area, machine frame 37 contains a gripping mechanism, indicated at 42 in FIG. 1, which has a pair of clamping jaws which grip the edge of the free end of the sheet web 45*a* and which can be lowered by means of a drive mechanism (not shown in the drawing) in a vertical direction and in the direction of arrow X2 into the vicinity of conveyor belt portion 12. There is simultaneously a spreading apart or expanding of gripping arms of gripping mechanism 42 in the lateral area of the sack stack provided with sheet covering 45, so that gripping mechanism 42, starting from an upper gripping position A can be moved into a lower expanding position B. During this downward movement of gripping mechanism 42, the sheet web 45*a* is spread out and drawn over sack stack 100. The opening of the sheet takes place by means of wedge plates located in the upper region of device 40 and which are not shown in the drawing.

The sheet web portion drawn over sack stack 100 is then cut from the remaining sheet web by means of a device 44. Device 44 is constructed as a welding-cutting device in such a way that simultaneously with the cutting of the sheet web portion drawn over stack 100, said portion is sealed in the cut area by means of a weld, so that the sheet web portion is sealed at the top and surrounds the stack in dome-like manner. As soon as stack 100 provided with sheet covering 45 has moved out of the region of the sheet covering draw-on device 40, gripping device 42 is moved into the upper gripping position A in order to remove another portion of sheet web 45*a* for wrapping a following sack stack.

In order to achieve a completely satisfactory feed of the sheet web 45*a* over the sack stack to be wrapped, machine frame 37 contains a lateral edge control device 43 by means of which the satisfactory guidance of web 45*a* is ensured. As a result, the completely satisfactory gripping of the sheet web in its edge area by gripping device 42 is ensured.

Due to the fact that the sheet web delivery reel 41 is arranged above the movement path of the sack stack, the sheet web 45*a* need only be guided over a short vertical zone, so that the lateral edge control device 43 also need only extend over a short movement area. This ensures a reliable and completely satisfactory supply of sheet web to the sack stack to be provided with the sheet covering 45.

Figure 10:
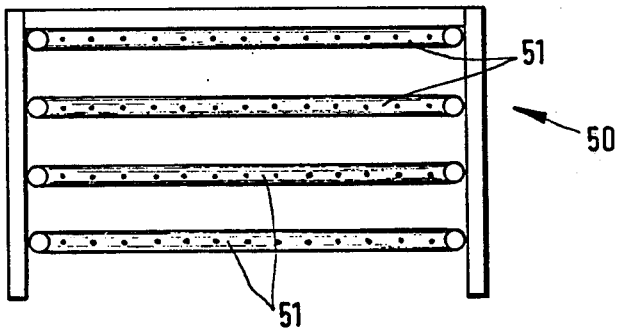
FIG. 10 a dome-shaped shrinkage device with ring nozzles located in the inner area.

Sack stack 100 provided with sheet covering 45 is discharged by conveyor belt portion 12 onto conveyor belt portion 13 of conveyor belt 10 which follows portion 12. A device for shrinking the dome-shaped sheet covering 45 is located in the vicinity of conveyor belt portion 13. The shrinkage device 50 is constructed as a dome-shaped enclosure, so that the arriving stack of sacks is introduced at one side into the inner surface of shrinkage device 50 and can move out again on the opposite side. During the shrinkage process, the two gate-like openings of shrinkage device 50 are sealed by means of two-part doors. Inside shrinkage device 50, are provided as shown in FIG. 10, a plurality of superimposed ring nozzles 51 in a supporting frame which is vertically adjustable within the shrinkage device 50. After introducing sack stack 100 wrapped in a sheet covering 45 into shrinkage device 50, the ring nozzles 51 are lowered to such an extent that an all-round shrinkage of covering 45 is possible as a result of the heating action. Ring nozzles 51 are jointly or individually operable, so that in the latter case it is possible to adapt the number of ring nozzles to the level of covering 45 and consequently stack 100. Thus, only the heat necessary for shrinking the predetermined size of covering 45 has to be provided. It is also possible to use other shrinkage device constructions.

Figure 4:
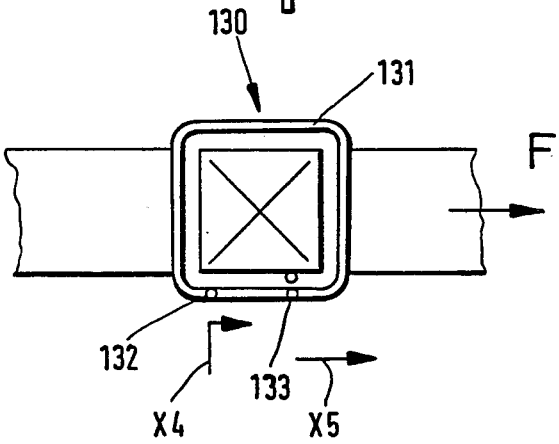
FIG. 4 a plan view of a device for shrinking the sheet covering drawn over a sack stack operating on a flame welding principle.
Figure 5:
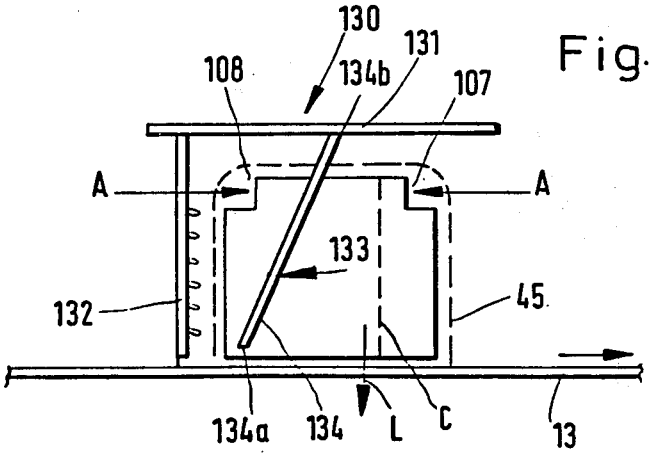
FIG. 5 a side view of the shrinkage device of FIG. 4.

Another embodiment of a shrinkage device is shown in FIGS. 4 and 5. This shrinkage device 130 comprises an approximately annular guide frame 131 positioned above the movement path of sack stack 100 and on which is suspended a vertical flame welding rod 132 rotated in the direction of arrow X4 by a drive mechanism not shown in the drawings. In the case of shrinkage device 130, the sheet is heated by means of small flames from the flame welding rod 132. The guide frame 131 is constructed in such a way that the flame welding rod 132 always has the same distance from the outer wall surface of covering 45 or stack 100 when performing its approximately circular movement path.

To prevent any accumulation or stagnation of the air present between the dome-shaped sheet covering 45 and the sack stack wall surface, a sheet pressing device 133 constructed as a pressing rod 134 is suspended on guide frame 131. This pressing rod 134 has a slope with respect to the flame welding rod 132 such that the distance between the lower free end 134*a* of rod 134 and flame welding rod 132 is smaller than that between the upper end 134*b* of rod 134 and flame welding rod 132. Pressing rod 134 is in advance of flame welding rod 132 in the direction of arrow X5 (FIG. 4). Pressing rod 134 has a plurality of spring-loaded pressure rollers, not shown in the drawings, which press the sheet of sheet covering 45 against the lateral wall surface of the sack stack, so that the air collected between covering 45 and said wall surface is forced away from the flame heating area. It is particularly advantageous to adopt an inclined position of pressing rod 134, because then the final residual air can be forced out of the space between the sheet covering and the wall surfaces of the stack. At the start of heating of the sheet covering by means of flame welding rod 132 shrinkage of the sheet commences. This first shrinkage zone is indicated at C in FIG. 5. If the flame welding rod 132 now passes round the stack starting from line C, it reaches the position shown in FIG. 5, so that air would collect in front of the first shrinkage zone C if no pressing rod 134 was provided and as a result when the rod 132 reached this area, no further smooth-shrunk sheet surface could be obtained due to the air which had collected therein. However, if according to the invention pressing rod 134 is used and is positioned in advance of the flame welding rod 132, the inclined position of rod 134 ensures that the air is forced out in the direction of arrow L from the gap between the sheet covering and the lateral wall surface of the sack stack. Thus, when the flame welding rod 132 has again reached the first shrinkage zone C, there is no longer any air cushion in front of this zone, thereby ensuring a completely uniform shrinkage of the sheet of covering 45 in all areas.

After leaving shrinkage device 50, the sack stack is supplied at the end of conveyor belt portion 13 to a device 60 for pressing the portions of sheet covering 45 in the vicinity of free spaces 107, 108 of stack 100 against the wall surfaces bounding said free spaces. This pressing device 60 comprises pressing rollers 61, 62 engaging in the vicinity of free spaces 107, 108 (FIG. 8) of the stack 100 and arranged in a supporting frame 67 in such a way that they come to rest in the upper area of the stack and are moved into the free spaces of the latter in the direction of arrow X3. By means of pressing device 60, the sheet portions located in the vicinity of free spaces 107, 108 are pressed onto the wall surfaces bounding the free spaces, so that the latter are formed in a completely satisfactory manner permitting the engagement therein of the forks of a corresponding constructed lifting mechanism for the purpose of transporting the stack without there being any damage to the sheet in said free space areas. Due to the fact that the top sheet 35 is applied in the vicinity of the base area of each sack stack before applying the sheet covering 45 a multilayer sheet construction is provided in the vicinity of free spaces 107, 108 giving a multiple protection of the most stressed areas.

Figure 9:
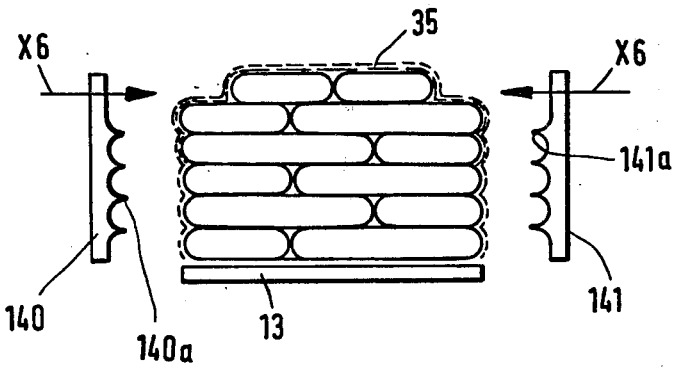
FIG. 9 the stack of sacks according to FIG. 8 with sheet pressing devices for adapting the sheet to the lateral contours of the stack.

A further arrangement including devices 140, 141, as shown in FIG. 9, can be positioned between devices 50 and 60 or can be combined with device 60. Device 140, 141, shown in FIG. 9, makes it possible, prior to cooling, to adapt the heated and shrunk sheet covering 45 to the contours of the lateral wall surface of the sack stack. As a result of the individual, superimposed sack layers, each sack stack has in its wall surface area an outline which is in particular formed by the drawn in portions between the tops or sides of the sacks of two superimposed sack layers. Devices 140, 141 are arranged on at least two facing lateral wall surfaces of the sack stack and have a shape corresponding to the outlines of the lateral wall surface of the sack stack. This shaping on devices 140, 141 is indicated at 140*a*, 141*a*. The shaping 140*a* and 140*a* of devices 140, 141 may also be generally attained by forming each of the devices 140, 141 of a plurality of superimposed, horizontally directed pressing rods which are adjustable as a function of the different layer heights and with the spacing between each two pressing rods corresponding to the height of a bundle or sack layer. The two facing devices 140, 141 are moved in direction X6 to adapt the shrunk covering sheet to the outline of the sack stack until 140*a*, 141*a* are located in corresponding recesses between, in each case, two sack layers. After the two devices 140, 141 are moved apart, the shrunk sheet covering has adapted to the outline of the lateral wall surfaces of the sack stack. After cooling the shrunk sheet, a very stable and strong sack stack is obtained, which is particularly advantageous if it is formed from sacks containing a material with a high flowability. In this way, it is possible to obtain very stable sheet-wrapped sack stacks. The devices or pressing rods 140, 141 are adjustable as a function of the different stack layer heights.

To this point the sack stack has traversed the conveyor belt with the auxiliary pallet or layer 106 at the top, and it is now necessary to rotate the stack by 180° to cover the as yet unprotected area of the stack with a sheet. To this end, a per se known device 70 is provided for rotating the sack stack by 180° in the vicinity of conveyor belt 10 or its portion 13*a*. Each sack stack is rotated in the direction of the feed path Y, so that even after the end of the rotation process, the sack stack comes to rest with its auxiliary pallet on the conveyor belt, so that the free spaces 107, 108 run parallel to the longitudinal direction of conveyor belt 10 in the vicinity of the auxiliary pallet formed by sack layer 106.

To prevent the movement of the sacks in the complete stack and maintain the free spaces 107, 108 in the vicinity of the auxiliary pallet, rotating mechanism 100 is provided with support devices 71 which engage into the free spaces 107, 108 of sack stack 100 and which can be constructed e.g. in the form of support beams or the like.

After rotating stack 100 by 180°, so that its auxiliary pallet rests on conveyor belt 10, the stack is discharged onto conveyor belt portion 14, in the vicinity of which is provided a device 80 for placing a top sheet 85 thereon and a following device 90 for shrinking said sheet 85.

Device 80 for placing a top sheet 85 on the area of the stack not protected by sheeting comprises a supporting frame 87 in which a sheet delivery reel 81 with a cutting mechanism 82 is provided above the movement path of stack 100. The requisite length for forming the sheet 85 is removed from reel 81 using devices not shown in the drawings. By means of cutting mechanism 82, the in each case removed length of cover sheet 85 is cut from the sheet web. The top sheet 85 used has a larger surface area than that formed by the upper sack layer, so that the edge portion of top sheet 85 zonally projects over the lateral wall surfaces of the sack stack in such a way that this all-round edge portion of sheet 85 comes to rest on the outside of the already shrunk covering sheet 45. The edge portion which projects laterally beyond the sack stack corresponds as regards width to approximately one third of the height of the stack. Shrinkable sheet material is used for top sheet 85 in the same way as for producing the sheet covering 45.

When the top sheet 85 has been placed on sack stack 100, it is heated and shrunk in device 90 by a local heating of sheet 85 in such a way that the already shrunk sheet covering 45 is not exposed to further heating. To engage the edge area of top sheet 85 on the sack stack, device 90 is provided with pressing devices 91, which press the laterally projecting portions of sheet 85 onto the shrunk sheet covering 45. Nozzles with outflowing compressed air can be used for pressing the laterally projecting portions of the top sheet onto the shrunk sheet covering. However, the pressing action can also be exerted by mechanical devices or the edges can be pressed and fixed to the covering by spot welding. The actual heating and shrinkage of top sheet 85 only take place when the laterally projecting portions thereof have been pressed onto the shrunk sheet covering (FIGS. 1 and 2).

Figure 6:
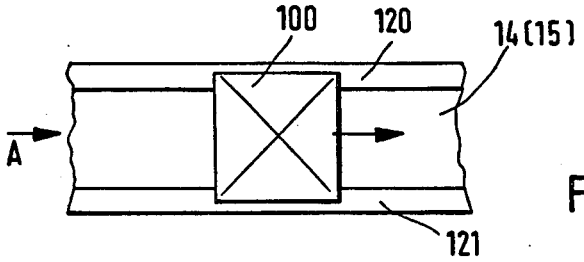
FIG. 6 a plan view of the stack of sacks on the conveyor belt with supporting devices engaging laterally onto the bottom recesses of a stack.

During the movement of sack stack 100 after leaving rotating mechanism 70, as shown in FIGS. 6 and 7, it is supported by means of devices 120, 121 engaging in the free spaces 107, 108 of the stack until the heated sheet has cooled. These supporting devices 120, 121 are arranged on either side of conveyor belt 10 and can be constructed as roller belts positioned above the actual conveyor belt 10 in such a way that the auxiliary pallet of each stack is supported on conveyor belt 10 while simultaneously the lower area of the stack projecting laterally from the auxiliary pallet is supported on devices 120, 121. This ensures that the stack wrapped with the sheet is supported in its base area in such a way that no deformation of the stack can occur until it is removed from the plant or until the heated, shrunk top sheet 85 has then been cooled.

In the end area, conveyor belt 10 also has a conveyor belt portion 15, which can also serve as a storage belt for the finished, sheet-packed sack stack and from which the individual stacks can be removed by means of corresponding devices.

Figures 1, 2:
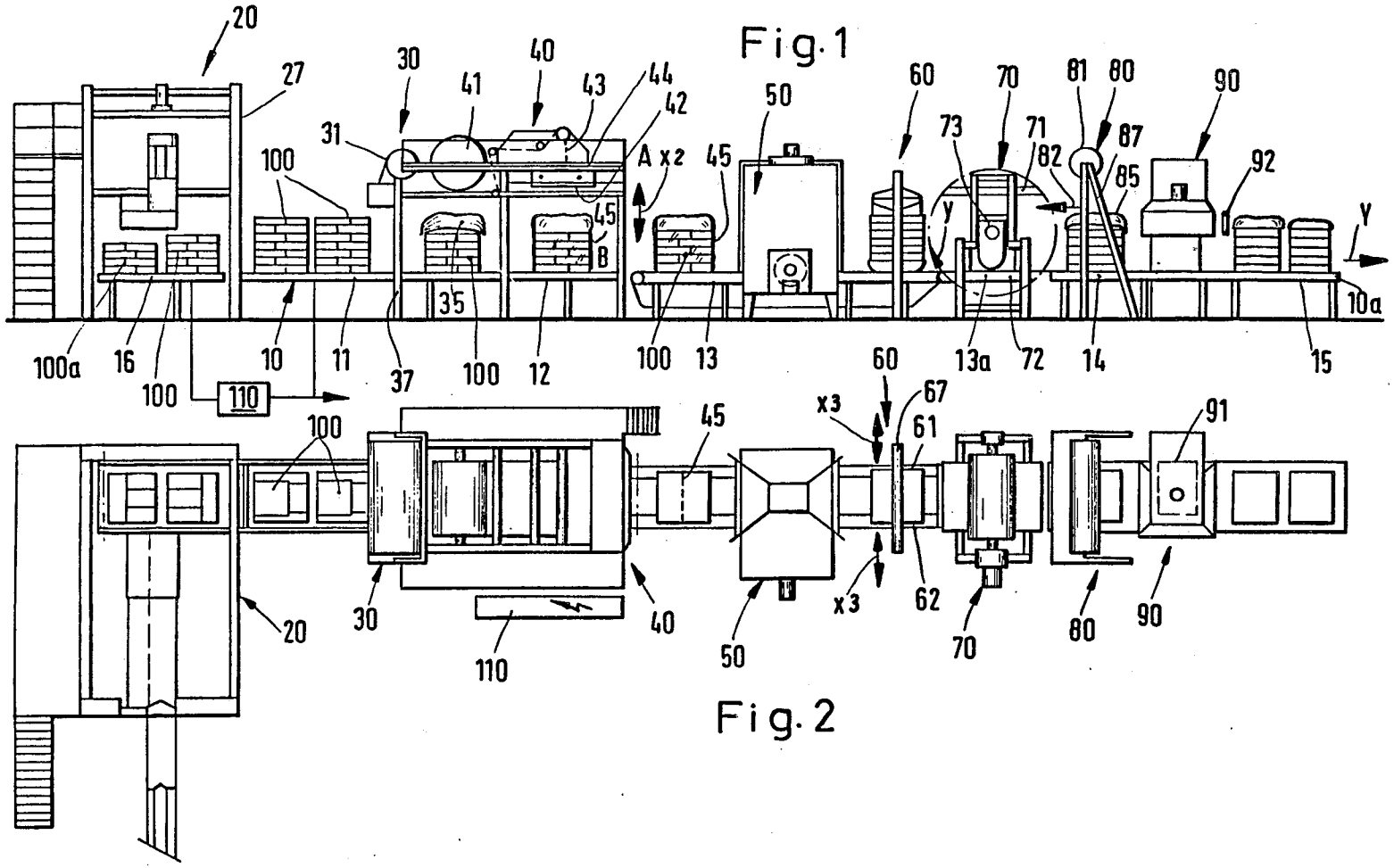
FIG. 1 a plant or installation for producing the pallet-less stack of sacks around which is shrunk the sheeting in a side view.
FIG. 2 a plan view of the plant.

To permit a faster cooling of the heated, shrunk top sheet 85 after the stack has left shrinkage device 90, the latter can be followed by an air cooling mechanism 92 by means of which cooling air is supplied to top sheet 95 from correspondingly arranged nozzles (FIG. 1).

In the feed direction, the discharge area of conveyor belt 10 is constructed as an accumulation belt, so that, without any transverse movement, one or more bundles can be simultaneously removed from the conveyor belt. One or more bundles can also be accumulated by means of the accumulation belt.

The aforementioned shrinkage devices can be replaced in per se known manner by tunnel or dome ovens or kilns or shrinkage columns.

What is claimed is:

1. A plant for producing pallet-less stacks of bundles, particularly sacks, around which is shrunk a sheet, with free spaces formed in the vicinity of the stack base for inserting conveying and lifting mechanisms, such as the arms of the fork of a fork lift truck or the like, using a stacking conveyor belt, by the combination of the following means arranged along the conveyor belt:

(a) a first means for forming individual bundles into layered stacks with a base surface at the top and with free spaces parallel to the stack feed direction on the conveyor disposed on either side of the bundle layer forming the stack base surface, said first means including a bundle row storage means, a horizontally and vertically adjustable packing table to which are supplied the individual bundle rows by means of a transfer mechanism for forming bundle layers on the packing table, and a bundle layer hold-back ledge in the horizontal movement area of the packing table for transferring the individual bundle layers from the packing table to the conveyor belt or onto the uppermost bundle layer of a partial stack already formed on the conveyor belt;

(b) a second means for applying a top sheet onto said bundle layer forming the base surface of the stack;

(c) a third means for covering the stack with a dome-shaped sheet of heat shrinkable plastic material, said third means including a welding and cutting means for sealing the top end of a sheet web portion for forming the dome-shaped sheet covering and for cutting the in each case necessary length of a sheet web portion for a stack from a hose-like sheet web, folded in concertina-like manner in the longitudinal side area, provided by a sheet delivery reel located above the stack movement path along said conveyor, wedge plates for opening the sheet web, a gripping device for gripping the open lower edge of the sheet web and for covering the stack with the sheet, said gripping device being movable by means of a drive mechanism from an upper gripping position to a lower spreading or expanding position laterally of the stack, and a lateral edge control device for guiding the sheet web from the reel to the vicinity of the stack to be wrapped;

(d) a fourth means for shrinking the dome-shaped sheet covering drawn over the stack;

(e) a fifth means for pressing the portion of the sheet covering located in the vicinity of said free spaces of the stack onto the wall surfaces bounding the latter, said fifth means comprising pressure rollers movable laterally into the area of the free spaces of the stack;

(f) a sixth means for rotating the stack with the shrunken sheet covering by 180° in the direction of the stack movement path and having supporting devices engaging the stack in the free spaces of the stack;

(g) a seventh means for placing a top sheet of shrinkable plastic material having a larger area than that formed by the upper bundle layer of the rotated stack onto the latter, said seventh means including a sheet delivery reel and a cutting device;

(h) a eighth means for shrinking said top sheet by local heating thereof and having pressing devices for pressing the laterally projecting portion of the top sheet onto the shrunken dome-shaped sheet covering the stack and a following air cooler for the heated top sheet;

(i) supporting means, disposed on the portion of said conveyor following said stack rotating sixth means, said supporting means extending into the free spaces of the stack for engaging and supporting the lower surface of the stack extending laterally from said bundle layer forming the stack base surface; and wherein the end portion of the conveyor belt is constructed as an accumulation belt.

2. A plant as defined in claim 1, wherein said fourth means includes a dome-shaped enclosure and means within said enclosure for applying heat to a stack within the enclosure including a plurality of superimposed ring shaped heat supplying nozzles, which are individually or jointly operable and of a size sufficient to encircle a stack.

3. A plant according to claim 1, wherein said fourth means includes an approximately annular guide frame located above the movement path of the stack on the conveyor belt with a vertical flame welding rod and a spring-loaded sheet pressing device displaceable along the guide frame, by means of a drive mechanism, for movement around a stack with the spring-loaded sheet pressing device in advance of the flame welding rod, said sheet pressing device being constructed as a vertical, sloping pressing rod, whose slope is such that the distance from the lower end of the pressing rod to the flame welding rod is smaller than that from the upper end of the pressing rod to the flame welding rod.

4. A plant according to claim 1, further commprising further means, disposed between said fourth and sixth means, for adapting the heated and shrunken sheet covering to the contours of the lateral wall surface of a stack, said further means including horizontally moveable pressing devices arranged on at least two facing sides of a stack for pressing the sheet covering against the stack so that its outline matches that formed by the individual superimposed bundle layers of the bundle stack.

5. A plant according to claim 4, wherein said horizontally moveable pressing devices comprise a plurality of superimposed, horizontally directed pressing rods which are adjustable as a function of the different layer heights, and with the spacing between each two pressing rods corresponding to the height of a bundle layer.

6. Apparatus for producing a pellet-less package including a stack of layered bundles enclosed in a plastic sheet and having free spaces or cavities formed in the vicinity of the package base for the insertion of the fork arms of a fork lift truck comprising a conveyor arrangement; and a plurality of means arranged in sequence along said conveyor so that a stack may be transported on said arrangement from one said means to the next, said plurality of means, in sequence, including:

a palleting means for forming a stack of layers of bundles such that the upper layer of the stack contains free spaces on either side of same which extend parallel to the feed direction of said conveyor arrangement;

means for applying a plastic cover sheet onto the top of said stack;

means for drawing a dome-shaped sheet of heat shrinkable plastic over the stack to cover same;

means for heat shrinking the dome-shaped sheet drawn over and covering the stack;

means for pressing the portions of the shrunken said dome-shaped sheet adjacent said free spaces into said free spaces and onto the wall surfaces of said stack bounding said free spaces;

turning means for rotating said stack with the shrunken said dome-shaped sheet by 180° in the direction of the stack conveying path so that said upper layer is now at the bottom;

means for applying a flat sheet of heat shrinkable plastic material of an area greater than the top surface of the inverted said stack to said top surface of the inverted said stack;

means for heat shrinking said flat sheet by local heating and for pressing the laterally projecting edges of said flat sheet against the sides of said stack so as to join same to said dome-shaped sheet; and horizontal support means, disposed on the portions of said conveyor arrangement following said turning means such that they extend into said free spaces of said stack, for engaging and supporting the portions of the bottom surface of said stack which define said free spaces.

7. An apparatus as defined in claim 6, wherein said support means comprises respective belt conveyors disposed on either side of said conveyor arrangement.

8. An apparatus as defined in claim 6, wherein said turning means includes means, extending into said free spaces of said stack, for engaging and supporting the wall surfaces of said stack defining said free spaces while said stack is being turned.

* * * * *